US009751222B2

(12) United States Patent
Kao

(10) Patent No.: US 9,751,222 B2
(45) Date of Patent: Sep. 5, 2017

(54) LOCKBACK FOLDING KNIFE WITH SAFETY MECHANISM

(71) Applicant: Chih-Chen Kao, Taoyuan (TW)

(72) Inventor: Chih-Chen Kao, Taoyuan (TW)

( * ) Notice: Subject to any disclaimer, the term of this patent is extended or adjusted under 35 U.S.C. 154(b) by 0 days.

(21) Appl. No.: 14/977,772

(22) Filed: Dec. 22, 2015

(65) Prior Publication Data

US 2017/0136634 A1 May 18, 2017

(30) Foreign Application Priority Data

Nov. 18, 2015 (TW) ..... 104218494 U

(51) Int. Cl.
*B26B 1/04* (2006.01)
*B26B 3/06* (2006.01)
*B26B 1/10* (2006.01)

(52) U.S. Cl.
CPC ..... *B26B 1/042* (2013.01); *B26B 1/10* (2013.01)

(58) Field of Classification Search
CPC ..... B26B 1/048; B26B 1/042; B26B 1/044; B26B 1/06; B26B 1/04
USPC ..... 30/161
See application file for complete search history.

(56) References Cited

U.S. PATENT DOCUMENTS 4,563,813 A * 1/1986 Fortenberry ..... B26B 1/042 30/161
2008/0295338 A1* 12/2008 Kao ..... B26B 1/042 30/161
2013/0133205 A1* 5/2013 Lo ..... B26B 1/048 30/160
2013/0212887 A1* 8/2013 De Buyer-Mimeure ..... B26B 1/042 30/161
2013/0255087 A1* 10/2013 Wang ..... B26B 5/00 30/156
2013/0291389 A1* 11/2013 Chen ..... B26B 1/048 30/160
2014/0360023 A1* 12/2014 Lake ..... B26B 1/044 30/161

* cited by examiner

*Primary Examiner* — Ghassem Alie
(74) *Attorney, Agent, or Firm* — Bacon & Thomas, PLLC

(57) ABSTRACT

A lockback folding knife having a handle, a blade body pivotally connected in the handle, a constraint member pivotally connected with the handle and having an end abutted with the peripheral edge of the blade body when the blade body is completely stretched out of or received into the handle, a first elastic element having an end fastened in the handle and other end abutted with other end of the constraint member, a locking pin protruded on the constraint member, and a safety switch pivotally connected in the handle and having a locking groove formed thereon corresponding to the locking pin. The locking groove and pin are fastened together when the blade body is completely stretched out of or received into the handle, and the locking groove is escaped from being fastened with the locking pin when the safety switch is applied force.

3 Claims, 6 Drawing Sheets

LOCKBACK FOLDING KNIFE WITH SAFETY MECHANISM

FIELD OF THE INVENTION

The present disclosure relates to a lockback folding knife, in particular, to a lockback folding knife with safety mechanism.

BACKGROUND OF THE INVENTION

A folding knife available in current market includes a handle and a blade body, an end of the blade body is pivotally connected to an end of the handle, and the blade body is rotatable about a pivoting location. The blade body can be rotated out of the handle or to be received into the handle. Therefore, upon demand, a user can rotate the blade body out of the handle or to be received into the handle. The folding knifes are gradually developed in various types and features, so manufacturers pay attention in solving drawbacks of the folding knifes to make the folding knifes in consumers good graces and provide the consumers with better experience in using the folding knifes.

Please refer to FIGS. 1A and 1B. A lockback folding knife 1 includes a handle 100, a blade body 110, a constraint member 130 and an elastic element 140. An end of the blade body 110 is pivotally connected in an end of the handle 100 by a first pivot pin, so as to enable the blade body 110 rotatable about the first pivot pin 120. The constraint member 130 is pivotally connected in the handle 100 by the second pivot pin 131, and has an end abutted with an end of the blade body 110 and other end extended towards other end of the handle 100. The constraint member 130 further has a pressing part 150 disposed at the other end thereof and protruded out of the handle 100. When the pressing part 150 is pressed, the end of the constraint member 130 is forced to move. Moreover, the elastic element 140 has an end fastened at a location in the handle 100 and away from the first pivot pin 120, and other end abutted with the other end of the constraint member 130. The elastic element 140 is used to push the constraint member 130 to constraint the blade body 110 in a status of being stretched out of the handle 100 or received in the handle 100. Therefore, the user just needs to press the pressing part 150 to make the constraint member 130 move towards the elastic element 140, so as to release the constraint applied on the blade body 110 by the constraint member 130, as shown in FIG. 1B.

Please refer back to FIGS. 1A and 1B. When the lockback folding knife 1 is placed in a package carried by the user, the pressing part 150 is exposed out of the handle 100, so the pressing part 150 may be accidentally pressed to release the constraint applied on the blade body 110 by the constraint member 130 while the folding knife 1 is collided or squeezed by an object in the package, and the blade body 110 is rotated out to be dangerous. In addition, during operation of the folding knife 1, the user may accidentally press the press portion 150 to make the constraint member 130 not constraint the blade body 110, which results in the blade body 110 being rotatable and not stably stretched out of the handle 100, and it is very inconvenient for the user.

In conclusion, what is need is a lockback folding knife with safety mechanism, to solve the multiple drawbacks of the conventional lockback folding knife and improve the convenience and safety for the user in operating the lockback folding knife.

SUMMARY

In order to solve drawbacks of easy accidental operation of the conventional lockback folding knife, the inventor develops the lockback folding knife with safety mechanism of the present invention according to practical experience, and long-term research and experiment.

The first objective of the present invention is to provide a lockback folding knife with safety mechanism. The lockback folding knife includes a handle, a blade body, a constraint member, a first elastic element, a locking pin and a safety switch. The handle is pivotally connected with an end of the blade body by a first pivot pin, and the constraint member is pivotally connected in the handle by a second pivot pin. The constraint member has an end extended to a peripheral edge of the blade body adjacent to the first pivot pin and other end extend towards other end of the handle. The constraint member has a locking pin disposed on the end thereof. The first elastic element is fastened in the handle and other end abutted with other end of the constraint member. When the blade body is completely stretched out of the handle or received into the handle, the first elastic element makes the end of the constraint member be abutted with the peripheral edge of the blade body adjacent to the first pivot pin. The safety switch has an end pivotally connected in the handle and other end exposed out of the handle, and a locking groove located thereon correspondingly to the locking pin. When the blade body is completely stretched out of the handle or received into the handle, the locking groove can be fastened with the locking pin to make the blade body be constrained in a safety status of being completely stretched out of the handle or received into the handle. The locking groove is escaped from a safety status of being fastened with the locking pin when the other end of the safety switch is applied force, so as to release the blade body. By means of the design, the user must operate the safety switch prior to the operation of the constraint member, to release the blade body into the status of free rotation. Therefore, usage convenience of the lockback folding knife of the present invention can be improved efficiently, and the user can prevent from releasing the blade body accidentally.

The second objective of the present invention is that the blade body has a first constraint part disposed at a peripheral edge of a blade back thereof and adjacent to the first pivot pin, and the constraint member has a second constraint part located at the end thereof correspondingly to the first constraint part, and the second constraint part can be fastened with the first constraint part when the blade body is completely stretched out of the handle. Therefore, the blade body can be stably kept in the status of being completely stretched out of the handle, and it is more convenient for the user to operate the lockback folding knife.

The third objective of the present invention is that the lockback folding knife further includes a second elastic element having an end fastened in the handle and other end abutted with the safety switch. The second elastic element is used to force the locking groove to automatically fasten with the locking pin when the blade body is completely stretched out of the handle or received in the handle. Therefore, the user does not need to push the safety switch manually and the usage convenience of the lockback folding knife can be greatly improved.

The fourth objective of the present invention is that the handle has a pressing groove recessed on a back edge thereof and corresponding to a pressing part of the constraint member, the pressing part is located between the second pivot pin and the other end of the constraint member, and exposed out of the handle through the pressing groove, so that the user can press the pressing part to make the end of the constraint member escape from the status of being fastened with the first constraint part while the locking groove is escaped from the safety status of being fastened with the locking pin. By manners of the design of the pressing groove, the user can quickly and easily know to press which part, so as to operate the constraint member.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1A:
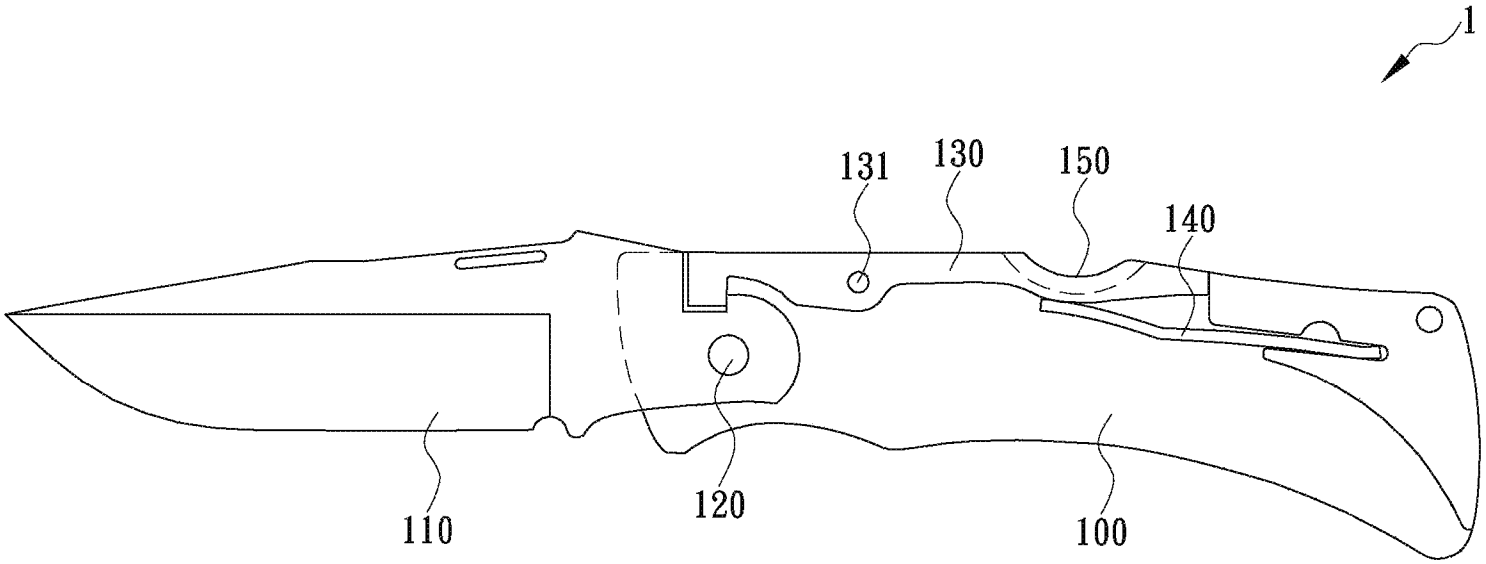
FIG. 1A(Prior Art)
FIG. 1A is a schematic view of a conventional lockback folding knife.
Figure 1B:
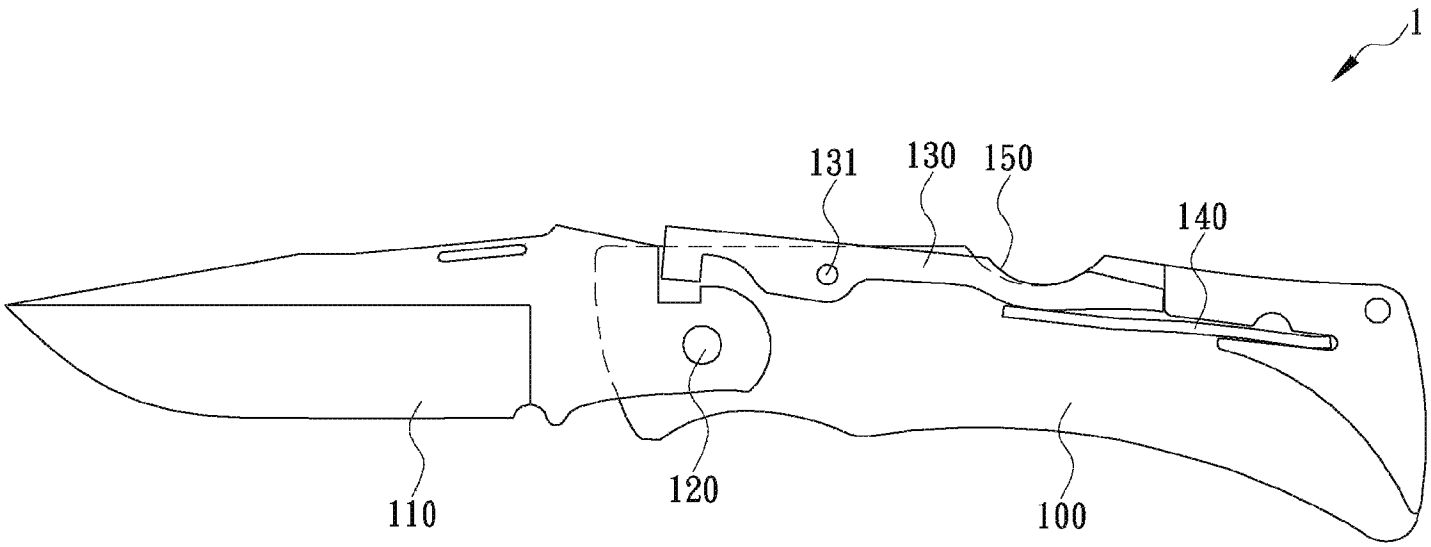
FIG. 1B(Prior Art)
FIG. 1B is other schematic view of the conventional lockback folding knife.

Reference will now be made in detail to the exemplary embodiments of the present disclosure, examples of which are illustrated in the accompanying drawings. Wherever possible, the same reference numbers are used in the drawings and the description to refer to the same or like parts.

Figure 2:
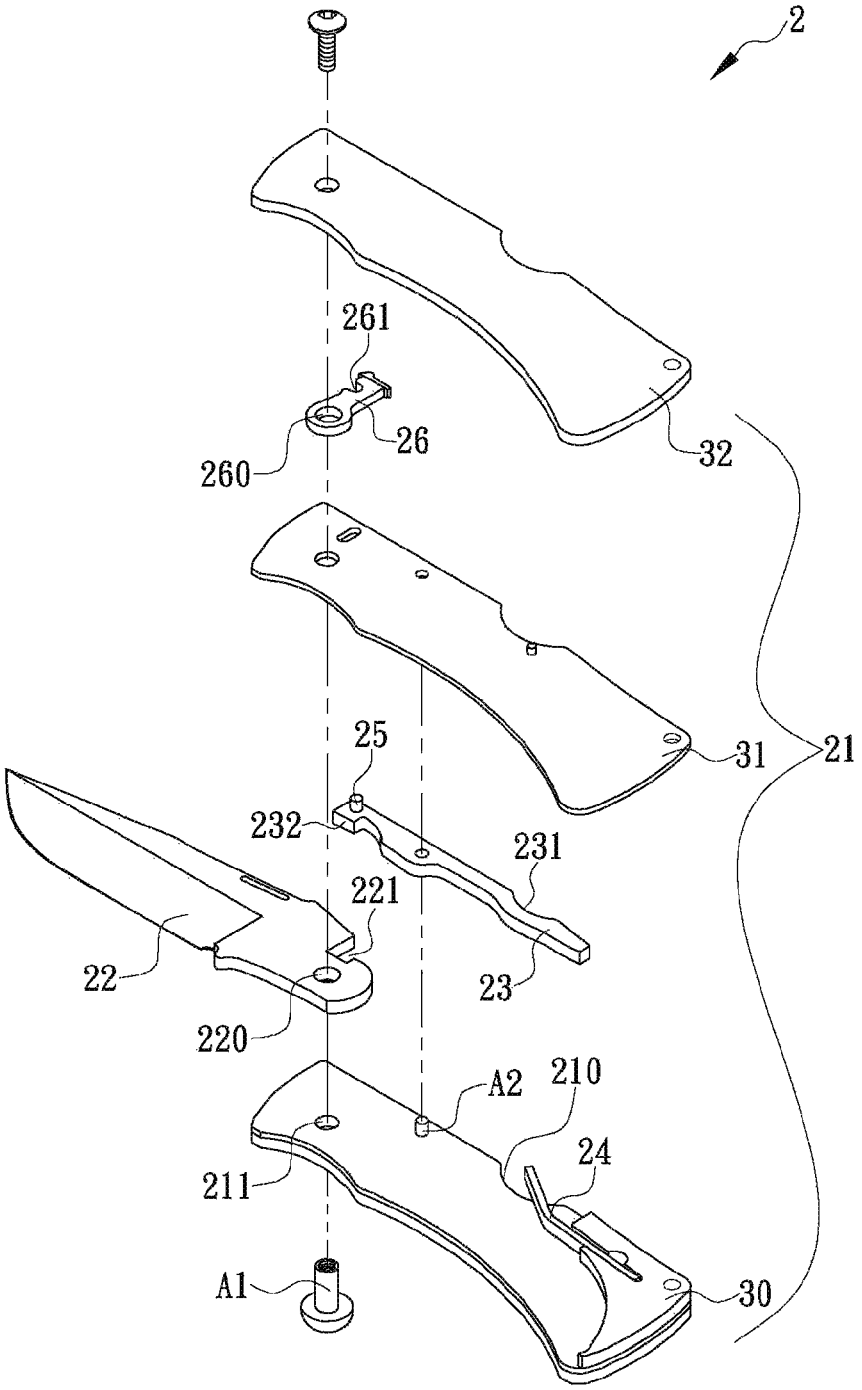
FIG. 2 is an exploded view of a lockback folding knife of the present invention.

The present invention discloses a lockback folding knife with a safety mechanism. Please refer to FIG. 2. In an embodiment, the lockback folding knife 2 includes a handle 21, a first elastic element 24, a locking rod 25 and a safety switch 26. It should be noted that the lockback folding knife 2 of the present invention can just be provided with the aforesaid elements to perform effects of the embodiments described below; however, the manufacturer can add other element in the lockback folding knife 2 upon practical demand, for example, to improve the beautiful performance and stability of the lockback folding knife 2. In addition, the shapes and structures of the handle 21, the blade body 2, or other element can be changed upon practical demand and are not limited to that shown in drawing figures of the present invention. As shown in FIG. 2, the handle 21 can be formed by combination of multiple elements including a base plate 30, a middle plate 31 and a cover shell 32. Only the handle 21 is shown in FIGS. 3A to 4B and other elements are omitted for the sake of easy understanding, but those have skill in the art can map the detailed features of the handle 21 to corresponding elements (such as the base plate 30, the middle plate 31 and the cover shell 32) after understanding total technical features of the present invention.

Please refer back to FIG. 2. In the embodiment, the handle 21 has a first pivot hole 211 cut therethrough an end thereof, and a pressing groove 210 recessed at a back edge thereof. The blade body 22 has a second pivot hole 220 formed at an end distal to a tip thereof. A first pivot pin A1 can be inserted through the first pivot hole 211 and the second pivot hole 220 to pivot the blade body 22 and the handle 21 integrally, so that the blade body 22 can be rotated out of the handle 21 about a pivoting location or to be received in the handle 21. The constraint member 23 is pivoted in the handle 21 by a second pivot pin A2 which is located between the first pivot hole 211 and the pressing groove 210. The constraint member 23 has an end extended to a peripheral edge of the blade body 22 adjacent to the first pivot pin A1, and other end extended to other end of the handle 21. A locking pin 25 is protruded on the constraint member 23 and adjacent to the end of the constraint member 23. The constraint member 23 has a pressing part 231 located correspondingly to the pressing groove 210 and between the second pivot pin A2 and the other end of the constraint member 23. The pressing part 231 is exposed out of the handle 21 through the pressing groove 210, so that the user can press the pressing part 231 to force the end of the constraint member 23 to move. Alternatively, in other embodiment of the present invention, the manufacturer can design the constraint member 23 without the pressing groove 210, and the pressing part 231 in a convex shape to be exposed out of the handle.

Please refer back to FIG. 2. The first elastic element 24 is sheet-shaped and has an end fastened in the handle 21, and other end abutted with the other end of the constraint member 23. The other end of the constraint member 23 can be applied force by the other end of the first elastic element 24 to move towards a back edge of the handle 21 and, at this time, the end of the constraint member 23 is moved away from the back edge of the handle 21, so that the end of the constraint member 23 can be abutted with the peripheral edge of the blade body 22 adjacent to the first pivot pin A1 when the blade body 22 is completely stretched out of the handle 21 or received into the handle 21. In this embodiment, the blade body 22 has a first constraint part 221 disposed on a peripheral edge of a blade back thereof adjacent to the first pivot pin A1, and the constraint member 23 has a second constraint part 232 disposed at the end thereof. When the blade body 22 is completely stretched out of the handle 21, the second constraint part 232 can be fastened with the first constraint part 221. The constraint parts 221 and 232 are provided to enable the blade body 22 and the constraint member 23 to be tightly abutted with each other; however, in other embodiment of the present invention, the manufacturer can design the lockback folding knife 2 without the constraint parts 221 and 232, or change types, locations and number of the constraint parts 221 and 232, for example, the blade body 22 has other constraint part located correspondingly to the first constraint part 221, so that the second constraint part 232 can be fastened with the other constraint part when the blade body 22 is received into the handle 21. Therefore, so long as the end of the constraint member 23 can be abutted with the peripheral edge of the blade body 22 adjacent to the first pivot pin A1 to constrain rotation of the blade body 22, the required connection relationship between the blade body 22 and constraint member 23 of the present invention can be achieved.

Figure 3A:
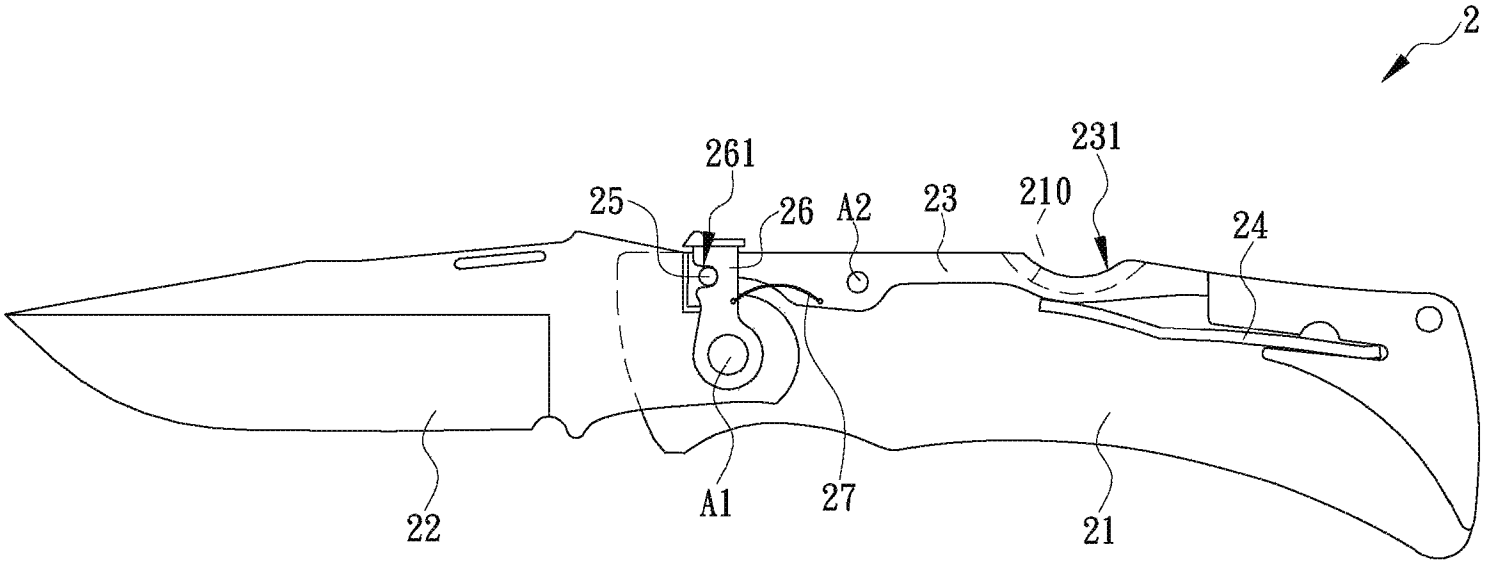
FIG. 3A is a schematic view of an embodiment of the lockback folding knife of the present invention, illustrating that the lockback folding knife is in a safety status while being used.
Figure 4A:
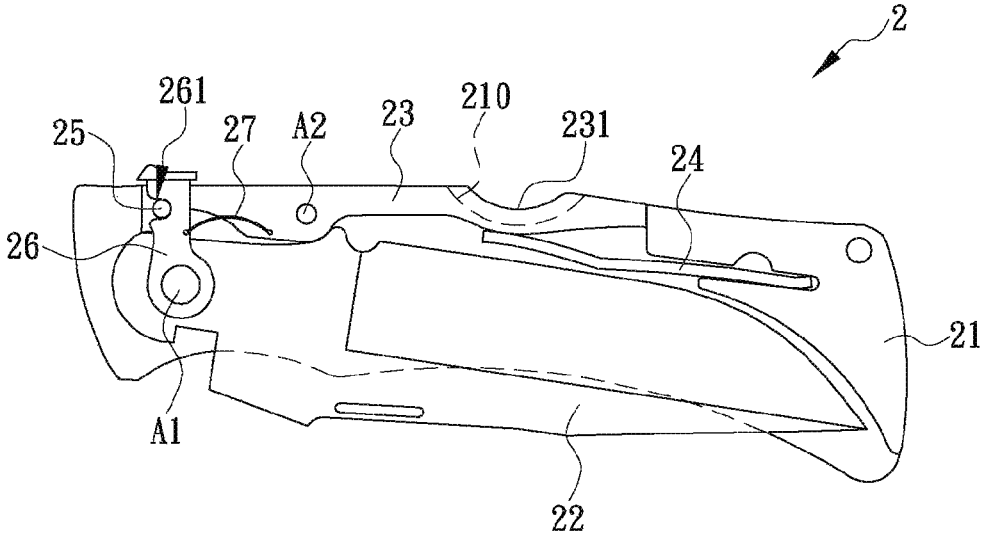
FIG. 4A is a schematic view of the embodiment of the lockback folding knife of the present invention, illustrating that the lockback folding knife is in a safety status while being received.

Please refer back to FIG. 2. In the embodiment, the safety switch 26 is sheet-shaped and has a third pivot hole 260 formed at an end thereof, so that the first pivot pin A1 can be inserted through the third pivot hole 260 to pivotally connect the safety switch 26 in the handle 21. Other end of the safety switch 26 is exposed out of the handle 21. However, in other embodiment of the present invention, the end of the safety switch 26 can be pivotally connected to other location in the handle 21 by other pivot pin, rather than the first pivot pin A1. Please refer to FIGS. 3A and 4A, the safety switch 26 has a locking groove 261 disposed thereon and correspondingly to the locking pin 25. When the blade body 22 is completely stretched out of the handle 21 as shown in FIG. 3A or received into the handle 21 as shown in FIG. 4A, the locking groove 261 and the locking pin 25 are fastened with each other. Therefore, when the user only presses the pressing part 231, the blade body 22 is constrained in a safety status of being completely stretched out of the handle 21 or being received in the handle 21 because the locking pin 25 cannot be escaped from the locking groove 261 and the second constraint part 232 also cannot be escaped from the first constraint part 221.

Figure 3B:
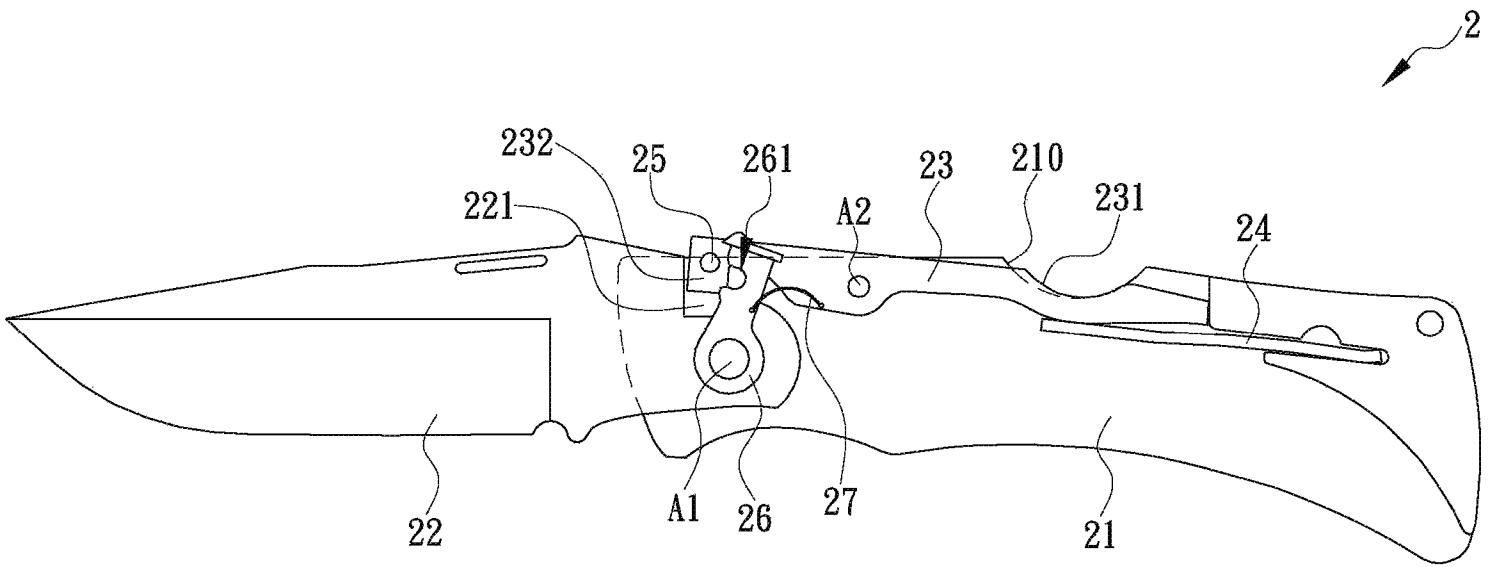
FIG. 3B is a schematic view of the embodiment of the lockback folding knife of the present invention, illustrating that the lockback folding knife is not in the safety status while being used.
Figure 4B:
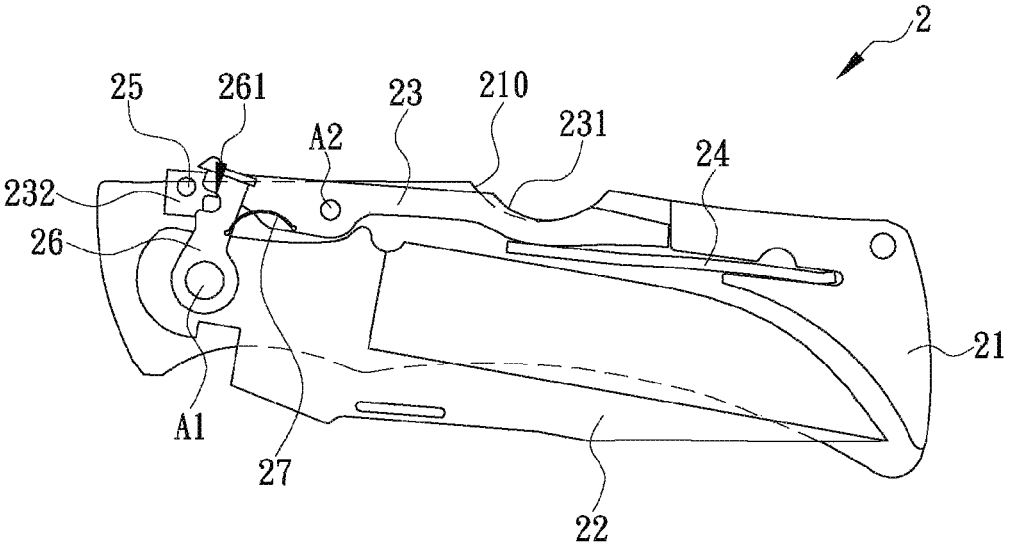
FIG. 4B is a schematic view of the embodiment of the lockback folding knife of the present invention, illustrating that the lockback folding knife is not in the safety status while being received.

Please refer to FIGS. 3B and 4B. When the user pokes the safety switch 26 by a finger to push the other end of the safety switch 26 to move, the locking groove 261 can be escaped from a safety status of being fastened with the locking pin 25 and, at this time, the user can press the pressing part 231 to make second constraint part 232 escape from the first constraint part 221 to release the blade body 22, so that the blade body 22 can be completely stretched out of the handle 21 or received into the handle 21. By means of the above-mentioned design, the user can release the blade body 22 to be rotated out of the handle 21 or received into the handle 21 by only operating the safety switch 26 prior to operation of the pressing part 231. When the lockback folding knife 2 is received in a package, the blade body 22 of the lockback folding knife 2 is hard to be released subject to collision or extrusion; or, when the user accidentally press the pressing part 231 during operation of the lockback folding knife 2, the blade body 22 is also not released under the safety status of the safety switch 26. Therefore, the lockback folding knife 2 of the present invention has a higher usage safety. It should be noted that, in this embodiment, the locking pin 25 is escaped from the locking groove 261 when the other end of the safety switch 26 is forced to move towards other end of the handle; however, in other embodiment of the present invention, the manufacturer can adjust the relative locations of the safety switch 26 and the locking pin 25, to enable the locking pin 25 to be escaped from the locking groove 261 only when the other end of the safety switch 26 is forced to move towards the end of the handle 21.

Moreover, in aforesaid embodiment, the user must push the other end of the safety switch 26 first to make the locking pin 25 escape from the locking groove 261, so as to rotate the blade body 22, and must then push the other end of the safety switch 26 again to fasten the locking pin 25 and the locking groove 261 together. Please refer back to FIGS. 3A to 4B. In order to improve the operation convenience of the lockback folding knife 2 for the user, the lockback folding knife 2 further includes a second elastic element 27 which has an end fastened in the handle 21 and other end abutted with the safety switch 26. The second elastic element 27 is used to apply force on the safety switch 26 to make the other end of the safety switch 26 move towards the end of the handle 21. Therefore, when the blade body 22 is completely stretched out of the handle 21 or received into the handle 21, the user just needs to loosen the safety switch 26 and the safety switch 26 is then forced to automatically move subject to the force provided by the second elastic element 27, so that the locking groove 261 can be fastened with the locking pin 25 automatically, and it greatly improves the convenience in using. In addition, the force of the second elastic element 27 must be overcome first to make the locking groove 261 of the safety switch 26 escape from the locking pin 25 later, so aforesaid structure can increase difficulty of accidentally releasing the blade body 22 and further improve the safety of the lockback folding knife 2.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A lockback folding knife, comprising:

a handle, having a first pivot pin inserted through an end thereof;

a blade body, having an end distal to a tip thereof and pivotally connected in the handle by the first pivot pin;

a constraint member pivotally connected with the handle by a second pivot pin, and said constraint member having an end extended to a peripheral edge of the blade body adjacent to the first pivot pin, and an other end extended towards an other end of the handle;

a first elastic element having an end attached to the handle and other end abutted with the other end of the constraint member, wherein the first elastic element is configured to make the end of the constraint member be abutted with the peripheral edge of the blade body adjacent to the first pivot pin when the blade body is completely stretched out of the handle or received into the handle;

a locking pin protruded from the constraint member and adjacent to the end of the constraint member;

a safety switch having an end pivotally connected in the handle and other end exposed out of the handle, said safety switch having a locking groove formed thereon and located correspondingly to the locking pin, wherein the locking groove and the locking pin are engaged when the blade body is completely stretched out of the handle or received into the handle, so as to constrain the blade body in a safety status of being completely stretched out of the handle or received into the handle, and wherein the locking groove is escaped from the safety status of being engaged with the locking pin when a force is applied to the other end of the safety switch, so as to release the blade body; and a second elastic element having an end attached to the handle and other end abutted the safety switch, wherein the second elastic element is configured to force the locking groove to automatically engage the locking pin when the blade body is completely stretched out of the handle or received in the handle.

2. The lockback folding knife according to claim 1, wherein the blade body has a first constraint part disposed at a peripheral edge of a blade back thereof and adjacent to the first pivot pin, and the constraint member has a second constraint part located at the end thereof and correspondingly to the first constraint part, and the second constraint part is engaged with the first constraint part when the blade body is completely stretched out of the handle.

3. The lockback folding knife according to claim 1, wherein the handle has a pressing groove recessed on a back edge thereof and corresponding to a pressing part of the constraint member, the pressing part is located between the second pivot pin and the other end of the constraint member, and said pressing part is exposed out of the handle through the pressing groove, so that a user presses the pressing part to make the end of the constraint member escape from a status of being engaged with the first constraint part when the locking groove is escaped from a safety status of being engaged with the locking pin.

* * * * *